US006095324A

United States Patent [19]

Mullin

[11] Patent Number: 6,095,324

[45] **Date of Patent: *Aug. 1, 2000**

[54] FOOD TRANSPORTATION CONTAINER

[76] Inventor: Robert Mullin, 6571 Serena La., Boca Raton, Fla. 33433

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,701

[22] Filed: Feb. 4, 1998

[51] Int. Cl.[7] ..... A45C 11/20

[52] U.S. Cl. ..... 206/204; 206/551

[58] Field of Search ..... 206/551, 204, 206/541, 550

[56] References Cited

U.S. PATENT DOCUMENTS 3,615,707 10/1971 Filz .
4,256,770 3/1981 Rainey .
4,351,997 9/1982 Mattisson et al. .
4,361,227 11/1982 Paulucci .
4,453,665 6/1984 Roccaforte et al. .
4,497,431 2/1985 Fay .
4,640,838 2/1987 Isakson et al. .
4,883,195 11/1989 Ott et al. .
4,891,482 1/1990 Jaeger et al. .
4,940,867 7/1990 Peleg .
5,423,477 6/1995 Valdman et al. .
5,472,139 12/1995 Valdman et al. .
5,605,231 2/1997 Borsboom et al. ..... 206/551

FOREIGN PATENT DOCUMENTS

WO94/12397 6/1994 WIPO .

*Primary Examiner*—Jacob K. Ackun
*Attorney, Agent, or Firm*—Jones & Askew, LLP

[57] ABSTRACT

A food transportation container which will maintain food in a fresh, hot and undeteriorated condition during delivery of the food from its point of origin to its destination, while being easy to use and store. The container will not impart undesirable taste to its contents. Furthermore, the container will not impede proper cutting of the food contained therein.

28 Claims, 4 Drawing Sheets

FOOD TRANSPORTATION CONTAINER

FIELD OF THE INVENTION

This invention relates in general to containers, and more particularly relates to a container for transporting food while maintaining the food in a fresh, hot, and undeteriorated condition.

BACKGROUND OF THE INVENTION

As the number of families with two working parents increases, so has the reliance of the typical family on food prepared outside the home by establishments, such as restaurants. An obvious extension of convenience from stopping on the way home to pick up a meal from a restaurant is delivery of the food, by the restaurant, from the restaurant to a home. Yet, despite the proliferation of so-called "delivery" and "take out" items and services, mechanisms for effectively transporting the prepared food from one location to another have changed little over the past several decades. Referring to a familiar example, this lack of innovation in the food transportation industry is readily apparent.

No item of food is delivered to more American homes in greater quantities than the pizza. As the business of pushing pizzas exceeds the 32 billion dollar mark annually in the United States alone, multitudes of both multi-national and local establishments vie for their "slice" of the action. The resulting competition is, of course, good for the consumer. In fact, the palates of today's pizza consumers have become accustomed to their favorite food being brick oven baked, deep dished, double cheese-filled crusted and covered with everything from pineapple to chicken to jalapeno peppers. By any standard, today's home-delivered creation is a vast improvement over the boxed mix your mother made and covered with dehydrated cheese 25 years ago.

At it's very best, though, a pizza delivered to your door pales in comparison to the same pizza served at a pizzeria. Apart from the ambiance of the red-checkered tablecloth and the spectacle of dough-tossing, pizzeria pizza is far superior because it has not suffered delivery deterioration.

The industry standard delivery time, pizza-to-door, is 30 minutes. The journey begins when the fresh, crisp-crusted, bubbling-cheese delicacy is removed from the oven and placed flat in the bottom of a box. Typically, the box is of the square, brown cardboard variety and may have a circular piece of reinforcing cardboard under the pizza to bolster its bottom. Then, the pizza is cut with a circular or "wheel" cutter. The box is closed, stacked on other pizza boxes and, when delivered, is sometimes placed in an insulating bag. The delivery driver tosses the bag into a delivery vehicle and makes the appointed rounds. It is during this journey that delivery deterioration occurs.

Unaware of the deterioration, the arrival of the pizza is met eagerly by the hungry hoarde. As the driver removes the pizza box from the bag, the aroma makes mouths water. Anticipation builds as the box is opened, revealing a pizza that is, by and large, similar in appearance to one a waiter would serve in the pizzeria. As the pieces are served, though, the toils of the pizza's travel become evident.

First, the pieces are difficult to separate. Pizza cutting tools typically comprise a wheel, sharp on its edge, rotatably attached to a handle. The pizza maker applies pressure to the wheel via the handle, causing the wheel to roll across the diameter of the pizza. As the wheel rolls, the pizza is cut by the sharp edge of the wheel. Round pizza cutters cannot conform to the 90 degree angle defined by the corner of the box. Accordingly, cutters of this type are unable to cut through the outer edge of the pizza at the point where the edge is closest to each side of the box. Extrication of the pizza typically requires tearing or additional cutting of at least some of the pieces.

Second, as that first piece is lifted eagerly to the mouth, it bends helplessly earthward. During transportation, the pizza crust has lost the rigid, crispy texture it had only 30 minutes earlier. The explanation for this is simple. As the steamy hot pizza is removed from the oven and placed in the box, it continues to give off moisture until it has cooled sufficiently. The standard cardboard box, though not perfectly airtight, retains substantially all of the moisture given off by the pizza. In essence, the pizza sits in a steam sauna during delivery. The final result is that the driest portion of the pizza (the crust) absorbs moisture and becomes limp.

Interestingly, the problem of moisture trapped within the pizza box has been previously addressed, though unsuccessfully. Pizza boxes have been constructed of absorbent material, such as certain semi-porous fibers. While such boxes removed some moisture from the trapped air, they were unable to remove enough moisture to maintain the pizza in a firm, fresh state. Additionally, some of these boxes, after absorbing large amounts of moisture, then lose their rigidity. In any event, the moisture problem has yet to be solved satisfactorily.

The final major component of pizza delivery deterioration is, to many, the single most significant problem with all food deliveries. As mentioned previously, the aroma and appearance of a delivered pizza differs little from its fresh counterpart. The first bite of the first piece reveals, however, the familiar and unmistakable taste of cardboard. Virtually all pizza boxes are brown. Almost all brown pizza boxes contain recycled paper. A sizable percentage of the recycled paper is newsprint. Well known to those in the packaging industry is the fact that the familiar and begrudgingly tolerated "taste" of cardboard originates from the newsprint used to make the cardboard. Nonetheless, solutions to this problem have not yet been effectively implemented.

Accordingly, there is a need for a food transportation container which will maintain the food in a freshly-cooked state during delivery of the food from its point of origin to its destination.

There is a further need for such a container which will not impart undesirable taste to its contents.

Finally, there is a need for a container which will not impede proper cutting of the food which could result in difficulty serving the food.

SUMMARY OF THE INVENTION

The present invention provides a food transportation container which maintains food in a freshly-cooked state during delivery of the food from its point of origin to its destination. Additionally, the present invention will not impart undesirable taste to its contents. Furthermore, the present invention will not impede proper cutting of the food which could result in difficulty serving the food.

An exemplary embodiment includes a base and a top, each having a respective top surface, a bottom surface and an outside edge. The base and top are comprised of a firm material, such as polyethylene, compressed pulp paper, aluminum, styrofoam or the like. The top surface of the base has a plurality of upward depending ridges on which the food rests during transportation. The respective outside edges of the top and base releasably interconnect.

A plurality of vent holes are incorporated into the top to allow limited flow of moist, heated air from the container.

Proximate to the vent holes and integrally connected to the bottom surface of the top is a moisture absorption means. Optimally, the moisture absorption means is a dry, compressed sponge. The sponge removes moisture from the air within the container and facilitates airflow within the container.

Another feature of an embodiment of the present invention is an intermediate portion of the base, disposed between the the bottom portion and outside edge of the base. The intermediate portion is shaped so to allow a circular cutting device to fully traverse the object of food, thereby completely cutting the object from edge to edge. Yet another feature of the exemplary embodiment is the resiliently deformable nature of the upward depending ridges of the base. This feature facilitates ease of cutting the food item while it is in the container without compromising the integrity of the container.

Still another feature of an embodiment of the present invention is the optional hinged connection between the respective outside edges of the top and base. Such optional configuration may be implemented in conjunction with interlocking outside edges.

Advantageously, these and other features described herein may be combined in numerous arrangements, taking numerous shapes, to accommodate transportation of a vast array of different foods including, but not limited to pizza, french fries, chicken nuggets and the like.

Accordingly, it is an object of the present invention to provide a food transportation container which will maintain food in a freshly-cooked state during delivery of the food from its point of origin to its destination.

It is yet another object of the present invention to provide such a container which will not impart undesirable taste to its contents.

A further object of the present invention is to combine the aforementioned features in a container which will facilitate the proper cutting of the food, thereby facilitating service of the food.

That the present invention and the preferred embodiments thereof overcome the drawbacks set forth above and accomplish the objects of the invention set forth herein will become apparent from the detailed description of the preferred embodiments to follow.

DETAILED DESCRIPTION

Figure 1:
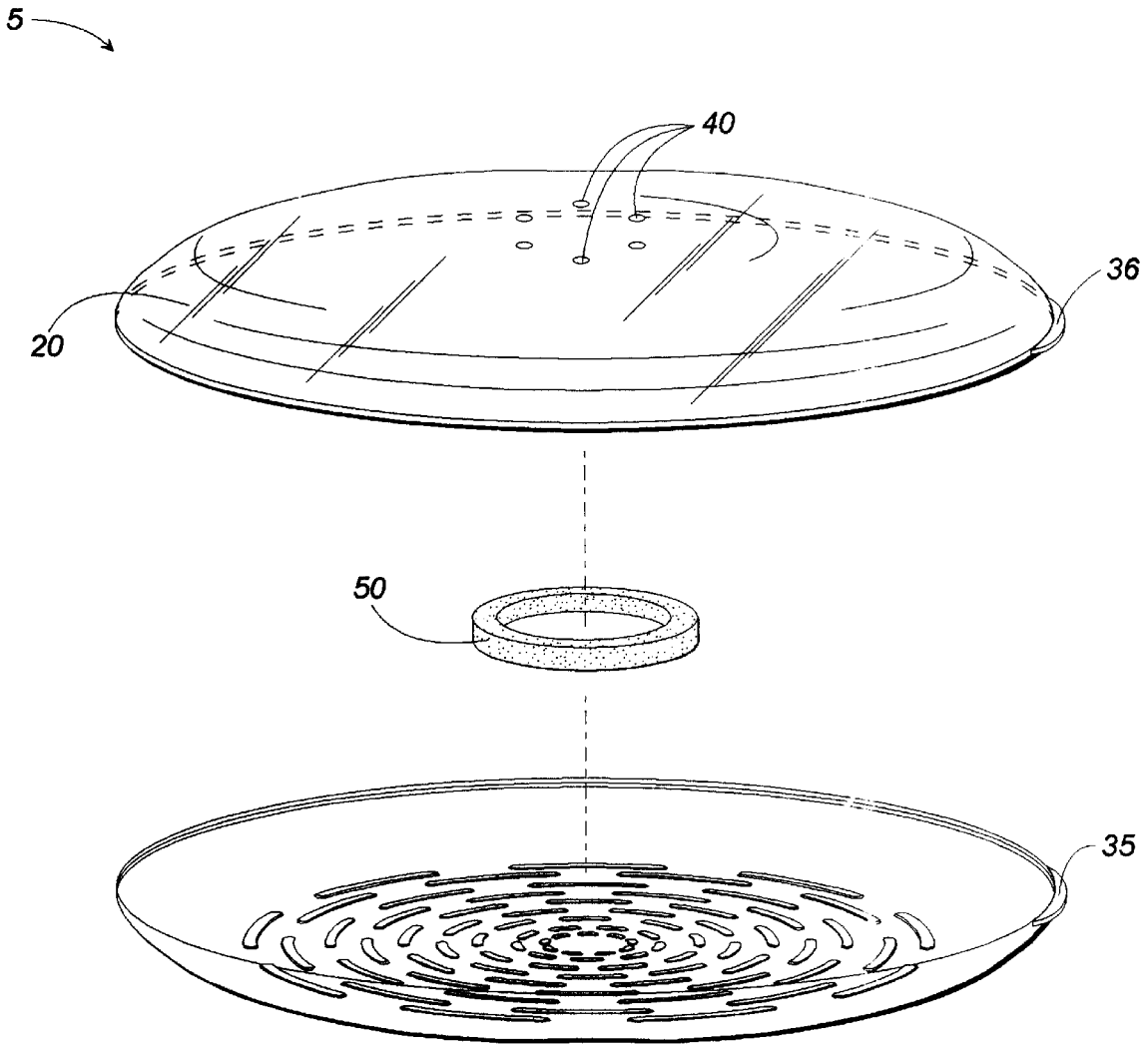
FIG. 1 is an exploded perspective view of an exemplary embodiment of the present invention.

Referring now to the drawings, FIG. 1 is an exploded perspective view of a preferred embodiment of the present invention. Specifically, FIG. 1 depicts a food transportation container 5 for transporting food while maintaining the food in a fresh, hot, and undeteriorated condition. More particularly, the illustrated embodiment is shaped so as to accommodate transportation of a pizza.

Figure 2:
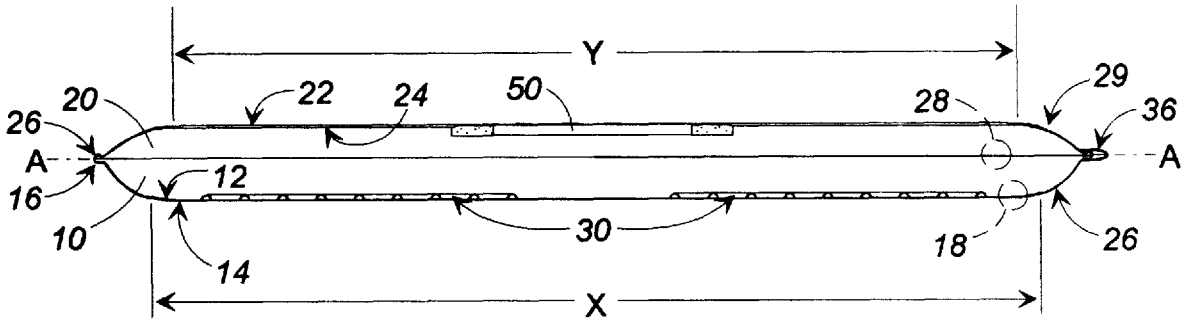
FIG. 2 is a side section view of an embodiment of an exemplary embodiment of the present invention.

FIG. 2 is a side section view of the present invention otherwise depicted in FIG. 1. As depicted in FIG. 2, the food transportation container 5 comprises, generally, a mating base 10 and top 20. Both the base 10 and the top 20 may be constructed of any one, or combination of a variety of well known and commercially available materials, including but not limited to virgin white pulp paper, aluminum, or styrofoam. In the preferred embodiment, however, the sections are formed of one of a vast array of well known firm plastics such as polypropylene. Advantageously, the preferred use of clear or translucent polypropylene may allow visual inspection of the contents of the container 5 without separating the base 10 and top 20. Ideally, such a polypropylene container would be formed to a thickness of approximately twenty thousandths of an inch (0.020"). This approximate thickness, with reasonable variation, will adequately attain the desired qualities of low cost, light weight, ease of manufacture, handling, and storage.

Structurally, the base 10 has a top surface 12, a bottom surface 14, and an outside edge 16. In the depicted embodiment, the base is substantially flat across diameter X. It will be understood that the actual dimension of diameter X is a design function which varies in accordance with the particular food to be transported in the food transportation container 5. The dimension of diameter X is otherwise unimportant inasmuch as it relates to any other dimension in the depicted embodiment. Nonetheless, for the purposes of illustration and description, the portion of the base 10 within diameter X will be referred to as the bottom portion 18 of the base 10.

In the embodiment depicted in FIG. 2, the bottom portion 18 of the base 10 defines a plurality of upwardly extending ridges 30, as shown. The exact number and shape of the ridges 30 is unimportant. The ridges should, however, provide sufficient support for the transported object of food, allowing the food to retain its basic shape while providing a relatively unobstructed flow of air between the ridges 30, the portion of the food (not shown) resting upon the ridges 30 and the top surface 12 of the bottom portion 18 of the base 10.

The base 10 includes an intermediate portion 19 disposed between the bottom portion 18 and the outside edge 16. Generally, the profile of the intermediate portion 19 (FIG. 2) defines an outwardly and upwardly extending arc disposed between the bottom portion 18 and the outside edge 16 of the base 10. Optionally, the outward and upward curvature of the intermediate portion 19 may be defined as the curvature of a bisected ellipse.

Still referring to FIG. 2, the top 20 of the food transportation container 5 has a top surface 22, a bottom surface 24 and an outside edge 26. In a preferred embodiment, a portion of the top 20 may have a diameter Y defining a surface referred to as a top portion 28. FIG. 2 depicts a food transportation container 5 having a planar top portion 28, which plane is substantially parallel to the plane in which bottom portion 18 lies. Such an arrangement may facilitate stacking one assembled food transportation container 5 on another. Additionally, such design will accommodate nestable stacking of the base 10 within the top 20, as may be desired during serving food from the container. It will be understood and appreciated, however, that other equivalent arrangements may be implemented to facilitate stacking a plurality of such food transportation containers 5 on top of each other. Namely, in an equivalent alternate embodiment, the top portion 28 may be formed as either an upwardly or downwardly extending shape, such as a parabolic or elliptical curve. In such an alternate configuration, the bottom portion 18 may be formed to nestably receive the shape of the top portion 28. Inasmuch as such an alternate configuration accomplishes the goals of supporting the food product as well as allowing the flow of air and absorption of moisture therefrom in the manner described hereafter, these alternate configurations are specifically contemplated.

In the depicted embodiment, the top 20 includes an intermediate portion 29 disposed between the top portion 28 and the outside edge 26. Generally, the profile of the intermediate portion 29 (FIG. 2) defines an outwardly and downwardly extending arc disposed between the top portion 28 and the outside edge 26 of the top 20. Optionally, the outward and downward curvature of the intermediate portion 29 may be defined as the curvature of a bisected ellipse. Though the exact dimensions of intermediate portions 29 and 19 are not critical, their respective curvature must be such as to facilitate the laminar flow of air within the container 5 from a point below the food object being transported to a point near the top portion 28. Additionally, inasmuch as the depicted embodiment is intended to transport a pizza, the curvature of the intermediate portions 19 of the base 10 must be such that it will accommodate a circular cutting wheel of the type previously described.

The outside edge 26 of the top 20 is formed so as to releasably interconnect with the outside edge 16 of the base 10. This interlocking relation may be accomplished by any of a wide variety of well known conventional designs. In the preferred embodiment, the interlocking relation defines a substantially air tight connection between the base 10 and the top 20.

Extending outwardly from both the base 10 and the top 20 are the release tabs 35 and 36, respectively. In the preferred embodiment, the release tabs 35 and 36 are integral to the base 10 and top 20, respectively. The tabs 35 and 36 are positioned at an arbitrary location adjacent to the respective outside edges 16 and 26 of the base 10 and the top 20. After base 10 and top 20 have been releasably interconnected via the interlocking mechanism provided by outside edges 16 and 26, the interlocking relation between the base 10 and the top 20 may be broken via an exertion of force in opposing directions on the release tabs 35 and 36, respectively. The exact dimensions and shape of the release tabs 35 and 36 are unimportant, so long as they are sized to facilitate an individual gripping the release tabs 35 and 36 and pulling hard enough to release the interlocked outside edges 16 and 26. To that end, the release tabs 35 and 36 may be virtually any shape and may, optionally, be textured.

In alternate embodiments, not shown, the interlocking relation between the base 10 and the top 20 may be broken by the exertion of force on a single release tab positioned on either the base 10 or the top 20. Furthermore, it is specifically contemplated that the interlocking relation between the base 10 and the top 20 may be broken without the implementation of any release tab. Rather, the separation may be effected by exerting a separating force on either the base 10, the top 20, or both.

Referring back to FIG. 1, the top 20 defines, through its thickness, a plurality of vent holes 40. As with other aspects of the food transportation container 5, the size and number of vent holes 40 depends upon the particular characteristics of the food which will be transported within the container. Referring to the current example of a pizza, the depicted embodiment incorporates six such vent holes 40, each of which is approximately 7⁄32 of an inch in diameter. Such a determination as to the number and size of vent holes 40 may easily change with not only the type of food, but may vary to accommodate the characteristics of a particular type of pizza to be carried in the container.

Figure 3:
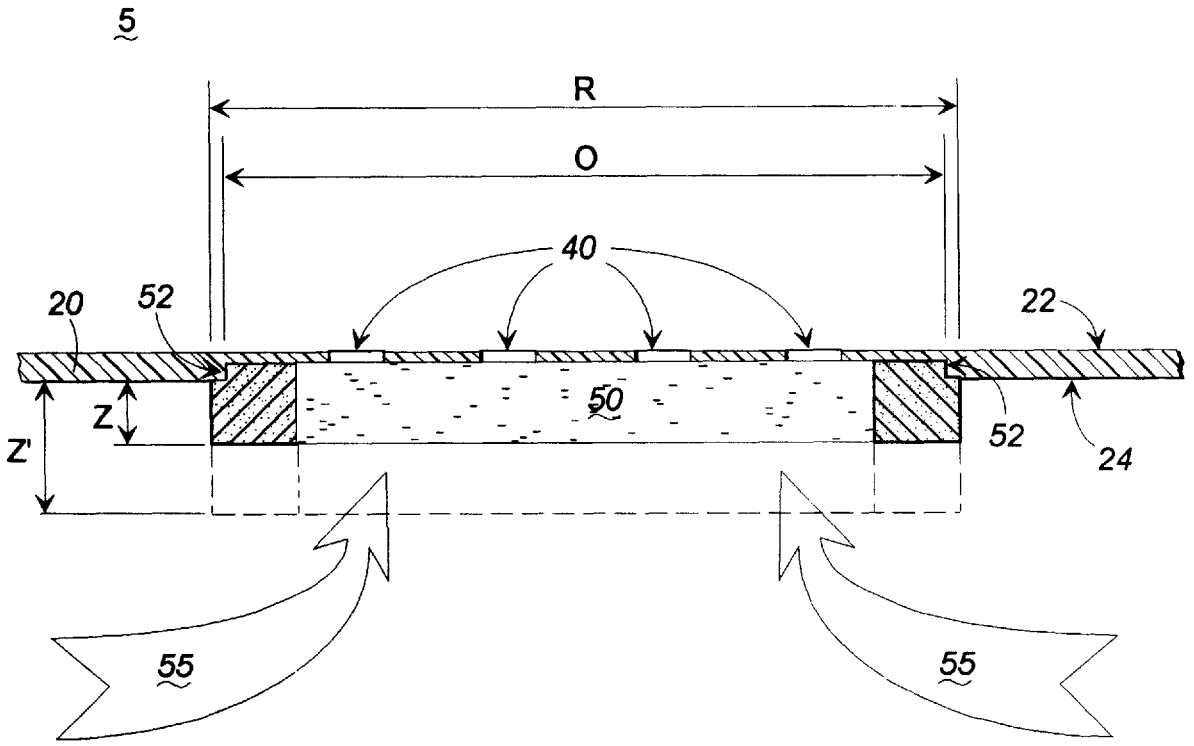
FIG. 3 is a partial section view of the top portion of the present invention, taken along the lines A—A in FIG. 2, in which an exemplary implementation of the moisture absorption means of the present invention is depicted.

Also depicted in FIG. 1 and shown more precisely in FIGS. 2 and 3 is a moisture absorption means 50 incorporated into the bottom surface 24 of the top 20. In the preferred embodiment, the moisture absorption means 50 is a compressed sponge in the basic shape of an annular or "ring" washer. Equivalently, the basic geometry of the sponge 50 may be varied to accommodate manufacturing practices, production costs, or the like. Specifically, the sponge may be any shape or combination of shapes which substantially and proximally surrounds the vent holes 40. Sponges of this type are readily available and manufactured by companies, such as 3M Corporation of Minneapolis, Minn.

Concerning the sponge 50, FIG. 3 is a partial section view of the top 20, taken along the lines A—A in FIG. 2, in which an exemplary implementation of the sponge 50 is depicted. It is advantageous that the inner diameter of the sponge 50 be large enough to surround substantially all of the vent holes 40 in the top 20. Optimally, the sponge 50 will be incorporated into the bottom surface 24 of the top 20 via a mechanical means. In the preferred embodiment, the sponge 50 is incorporated into the bottom surface 24 of the top 20 by frictional engagement means 51. Specifically, the frictional engagement means 51 provides a mechanical engagement between the portion of the sponge 50 adjacent to the bottom surface 24 of the top 20 and the bottom surface 24, itself.

FIG. 3 depicts one such mechanical engagement between sponge 50 and top 20. Specifically, the mechanical engagement means 51 may be accomplished by forming the bottom surface 24 of the top 20 so that a formed indentation of a predefined shape, defined by edge 52, is formed therein. The shape defined by edge 52 has a diameter O which is slightly smaller than the outside diameter R of the sponge 50. During attachment of the sponge 50 to the top 20, the sponge 50 is radially compressed about its periphery to fit within the shape defined by the edge 52. Upon release of the radially compressive force from the outer periphery of the sponge 50, the inherent resilience of the sponge 50 causes the outer dimension of the sponge 50 to seek to return to its uncompressed outside dimension R. Because the diameter O of the shape defined by the edge 52 formed in the bottom surface 24 of the top 20 is smaller than the outside diameter R of the sponge 50, the expansion of the sponge 50 to its original uncompressed state generates frictional force by the sponge 50 against the edge 52 of the bottom surface 24. The respective dimensions of the shape defined by the edge 52 and the sponge 50, O and R, are such that the expansion of the sponge 50 within the formed shape generates sufficient frictional force to retain the sponge 50 within the shape formed by the edge 52, notwithstanding forces such as gravity and jarring during transportation.

It will be understood, as previously specified, that the sponge 50 may be formed, manufactured, or otherwise manipulated into any of a wide variety of geometric shapes. In the employment of such alternate shapes, it follows that the formed shapes, defined by edges analogous to the edge 52 in the present example, utilize the above-stated principles to retain the respectively shaped sponge or sponges therein.

It will be further understood and appreciated that a variety of other frictional and/or adhesion means are available for incorporating the sponge 50 into the bottom surface 24 of the top 20. Specifically, well known fasteners such as Velcro, glue, tape, staples, etc., will provide sufficient bonding between the sponge 50 and the top 20 to retain the sponge 50 in its desired location.

Still referring to FIG. 3, the functionality of the sponge 50 is shown. As a heated article of food is placed in the food transportation container 5 and the respective interlocking outer edges 16 and 26 of the base and top are interconnected, moisture within the heated article is transformed into steam 55. As the volume of steam 55 within the container 5 increases, the steam is directed toward the plurality of vent holes 40 in the top 20 of the container 5 in accordance with basic scientific principles. The steam within the container flows in laminar fashion along the inside surfaces of the container. The plurality of vents 40 within the top portion 28 of the top 20 allow some of the steam 55 to flow from inside the food transportation container 5 to outside the container. As steam flow in this laminar manner is established, the steam 55 passes over the sponge 50 on its way to the plurality of vent holes 40. Accordingly, the dry, compressed sponge (initially of a thickness Z) absorbs moisture from the steam 55. During such flow, the sponge 50 absorbs moisture from the air and gradually expands to thickness Z'.

Importantly, the sponge 50 also absorbs moisture from the portion of the steam 55 which does not escape the container 5 through the plurality of vent holes 40. Accordingly, a component of air trapped within the container 5 remains in the container 5 in a heated state with a diminished amount of latent moisture contained therein. As this air gradually cools, it circulates toward the base 10 of the container, allowing the flow of newly heated (and moist) air to move in laminar fashion toward the sponge 50 in the top 20 of the container 5.

Figure 4:
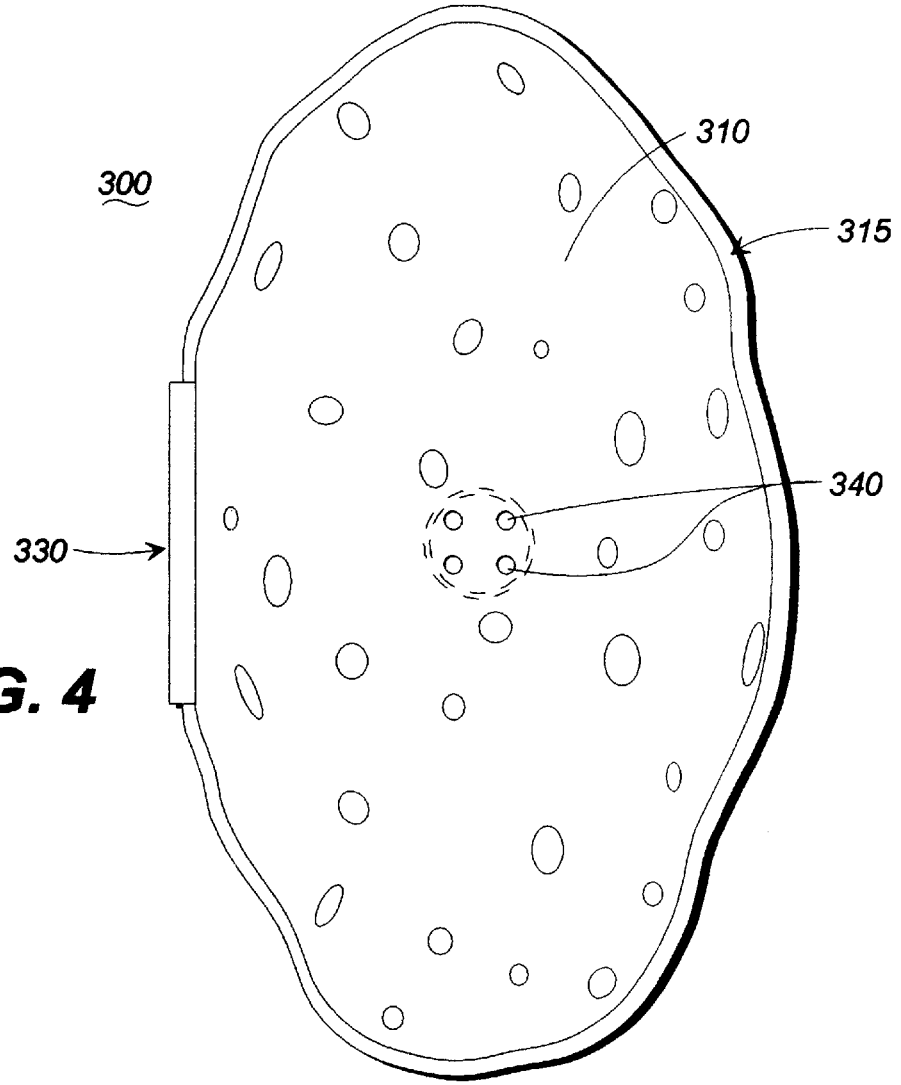
FIG. 4 is a top view of an alternate embodiment of the present invention, wherein the present invention is in a closed configuration.
Figure 5:
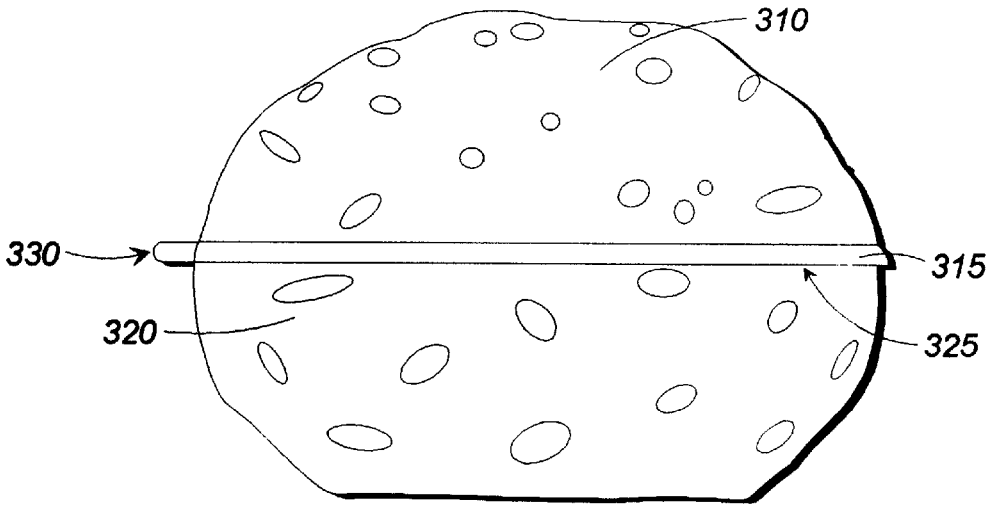
FIG. 5 is a top view of an alternate embodiment of the present invention, wherein the present invention is in a closed configuration.
Figure 6:
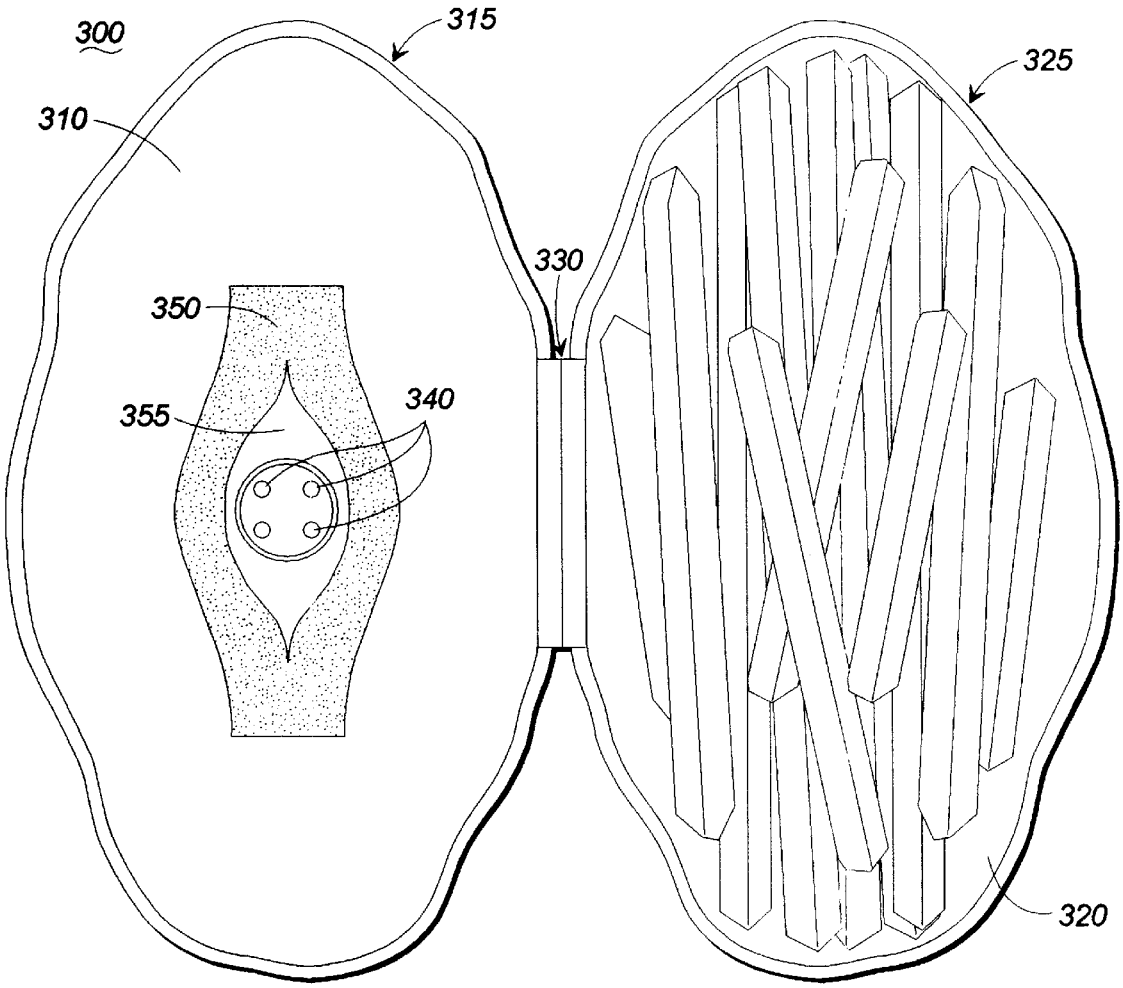
FIG. 6 is a top view of an alternate embodiment of the present invention, wherein the embodiment is in an open configuration.

Now referring to FIGS. 4, 5, and 6, an alternate embodiment of the present invention is depicted. As previously mentioned, the size and shape of the present invention may be readily modified to accommodate different types of foods having different characteristics. FIGS. 4 and 5 depict, respectively, top and end views of a food transportation container employing the claimed principles of food preservation while being formed in the shape of a potato for the transportation of french fries. The food transportation container 300 comprises, generally, a top 310, a base 320, and a hinge 330 connecting the top 310 to the base 320.

More particularly, this embodiment of the present invention is comprised of a firm material which, in the case of transporting a food such as french fries, is optimally "virgin white" recycled paper formed under high pressure to an end thickness of approximately one-quarter of an inch to three-eighths of an inch. Despite this choice of materials for this particular item of food, it will be understood and appreciated that any of the wide variety of previously discussed materials may be implemented to create such a container 300.

The base 320 has an outside edge 325 which, at at least one point about its periphery, is integrally connected to or formed into a hinge 330. The top 310 is also integrally connected to, or formed into, the hinge 330 at at least one point about the periphery of its outside edge 315. Additionally, the top 310 defines, through its thickness, a plurality of vent holes 340. As is evident in FIGS. 4 and 5, the container 300 is closed. The closed configuration is achieved by rotating the top 310 about an axis defined by the hinge 330 so that the outside edge 315 of the top 310 releasably interconnects with the outside edge 325 of the base 320.

FIG. 6 is a top view of the alternate embodiment of the container 300, wherein the container 300 is in an open configuration, displaying the food contents (not claimed) of the container 300. FIG. 6 illustrates a generally rectangular sponge 350 defining, through its thickness, an inner area 355. The inner area 355 of the sponge 350 is essentially adjacent to the plurality of vent holes 340. Surrounding the plurality of vent holes 340 is a moisture absorption means such as the sponge 350. As in the previously discussed embodiment, the exact shape of the sponge 350 is not significant, as long as it substantially surrounds the plurality of vent holes 340.

The sponge 350 may be incorporated into or attached to the bottom surface of the top 310 by any of the methods previously discussed, or any variation or combinations thereof. Once again, the preferred attachment configuration for the alternate embodiment of the present invention is the same as for the previously discussed embodiment. Namely, the bottom surface of the top 310 can be formed, during manufacture, to mechanically receive a dried, compressed sponge 350. Once the inwardly compressive force is released from the sponge 350, the sponge 350 expands to frictionally abut the formed shape in the bottom surface of the top 310.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto and not limited to the specific embodiments articulated hereinabove.

What I claim is:

1. A food transportation container comprising:

a) a base having a top surface, a bottom surface and an outside edge comprised of a firm material;

b) a top having a top surface, a bottom surface and an outside edge, comprised of a firm material, wherein the outside edge of the top releasably interconnects with the outside edge of the base;

c) a means for venting said container, comprising a plurality of substantially unobstructed vent holes incorporated into the top, through its thickness, and substantially close to its center; and d) a moisture absorption means incorporated into the bottom surface of the top, wherein the moisture absorption means surrounds the plurality of vent holes and does not obstruct the vent holes.

2. The food transportation container of claim 1, wherein the base further includes a bottom portion and an intermediate portion which intermediate portion connects the bottom portion and the outside edge and defines an arc and the top surface of the base has a plurality of upward depending ridges that are resiliently deformable and are interrupted to allow relatively unobstructed flow of air between the ridges.

3. The food transportation container of claim 1, wherein the outside edge of the top is hingedly connected to the outside edge of the bottom.

4. The food transportation container of claim 1, wherein the outside edge of the top interconnects with the outside edge of the bottom in an interlocking fashion and the interlocking interconnection between the outside edge of the top and the outside edge of the bottom is essentially airtight.

5. The food transportation container of claim 1, wherein the moisture absorption means is incorporated into the bottom surface of the top by frictional means.

6. The food transportation container of claim 5, wherein the frictional means comprises the bottom surface of the top defining a formed shape, the formed shape having a first outer dimension;

the moisture absorption means having a second outer dimension, the second outer dimension being slightly larger than the first outer dimension such that when the second outer dimension of the moisture absorption means is compressed, fitted within the formed shape of the bottom surface of the top and released, the second outer dimension expands to frictionally abut the first outer dimension of the formed shape, whereby the moisture absorption means is held within the formed shape by frictional forces exerted between the second outer dimension and the first outer dimension.

7. The food transportation device of claim 1, each of the top and the base being sized for nestable accommodation of the other.

8. The food transportation container of claim 1, wherein the base and top are sized to accommodate a pizza.

9. The food transportation container of claim 2, wherein the base and top are shaped to accommodate a pizza and the arc defined by the intermediate portion of the base is a radius that is substantially equal to the radius of a conventional pizza cutting wheel.

10. The food transportation container of claim 1, wherein the base and the top are in the shape of a potato.

11. A food transportation container comprising:

a) a base having a top surface, a bottom surface, and an outside edge comprised of a firm material;

b) a top having a top surface, a bottom surface, and an outside edge, comprised of a firm material, wherein the outside edge of the top releasably interconnects with the outside edge of the base;

c) a plurality of vent holes incorporated into the top through its thickness and remote from its edge;

d) a moisture absorption means incorporated into the bottom surface of the top;

e) the base further includes a bottom portion and an intermediate portion which intermediate portion connects the bottom portion and the outside edge and defines an arc; and f) the top surface of the base has a plurality of upward depending ridges that are resiliently deformable and interrupted to allow relatively unobstructed flow of air between the ridges.

12. The food transportation container of claim 11, wherein the outside edge of the top is hingedly connected to the outside edge of the bottom.

13. The food transportation container of claim 11, wherein the moisture absorption means is incorporated into the bottom surface of the top by frictional means.

14. The food transportation container of claim 13, wherein the frictional means comprises the bottom surface of the top defining a formed shape, the formed shape having a first outer dimension;

the moisture absorption means having a second outer dimension, the second outer dimension being slightly larger than the first outer dimension such that when the second outer dimension of the moisture absorption means is compressed, fitted within the formed shape of the bottom surface of the top and released, the second outer dimension expands to frictionally abut the first outer dimension of the formed shape, whereby the moisture absorption means is held within the formed shape by frictional forces exerted between the second outer dimension and the first outer dimension.

15. The food transportation device of claim 11, each of the top and the base being sized and shaped for nestable accommodation of the other.

16. The food transportation container of claim 11, wherein the base and top are sized to accommodate a pizza.

17. The food transportation container of claim 11, wherein the base and top are shaped to accommodate a pizza and the arc defined by the intermediate portion of the base is a radius that is substantially equal to the radius of a conventional pizza cutting wheel.

18. The food transportation container of claim 11, wherein the base and the top are in the shape of a potato.

19. A food transportation container, comprising:

a) a base having a top surface, a bottom surface and an outside edge comprised of a firm material;

b) a top having a top surface, a bottom surface and an outside edge, comprised of a firm material, wherein the outside edge of the top releasably interconnects with the outside edge of the base;

c) a plurality of substantially unobstructed vent holes incorporated into the top, through its thickness, and substantially close to its center; and d) a moisture absorption means incorporated into the bottom surface of the top, wherein the moisture absorption means has a space through its thickness, the space communicating with the vent holes to facilitate escape of moisture from the container.

20. The food transportation container of claim 19, wherein the base further includes a bottom portion and an intermediate portion which intermediate portion connects the bottom portion and the outside edge and defines an arc and the top surface of the base has a plurality of upward depending ridges that are resiliently deformable and are interrupted to allow relatively unobstructed flow of air between the ridges.

21. The food transportation container of claim 19, wherein the outside edge of the top is hingedly connected to the outside edge of the bottom.

22. The food transportation container of claim 19, wherein the outside edge of the top interconnects with the outside edge of the bottom in an interlocking fashion and the interlocking interconnection between the outside edge of the top and the outside edge of the bottom is essentially airtight.

23. The food transportation container of claim 19, wherein the moisture absorption means is incorporated into the bottom surface of the top by frictional means.

24. The food transportation container of claim 23, wherein the frictional means comprises:

the bottom surface of the top defining a formed shape, the formed shape having a first outer dimension;

the moisture absorption means having a second outer dimension, the second outer dimension being slightly larger than the first outer dimension such that when the second outer dimension of the moisture absorption means is compressed, fitted within the formed shape of the bottom surface of the top and released, the second outer dimension expands to frictionally abut the first outer dimension of the formed shape, whereby the moisture absorption means is held within the formed shape by frictional forces exerted between the second outer dimension and the first outer dimension.

25. The food transportation device of claim 19, each of the top and the base being sized and shaped for nestable accommodation of the other.

26. The food transportation container of claim 19, wherein the base and top are sized to accommodate a pizza.

27. The food transportation container of claim 20, wherein the base and top are shaped to accommodate a pizza and the arc defined by the intermediate portion of the base is a radius that is substantially equal to the radius of a conventional pizza cutting wheel.

28. The food transportation container of claim 19, wherein the base and the top are in the shape of a potato.

* * * * *